US010604340B2

(12) United States Patent
Busch

(10) Patent No.: US 10,604,340 B2
(45) Date of Patent: Mar. 31, 2020

(54) MODULAR WASTE CONTAINERS

(71) Applicant: BUSCH SYSTEMS INTERNATIONAL INC., Barrie (CA)

(72) Inventor: Craig Busch, Barrie (CA)

(73) Assignee: BUSCH SYSTEMS INTERNATIONAL INC., Barrie (CA)

( * ) Notice: Subject to any disclaimer, the term of this patent is extended or adjusted under 35 U.S.C. 154(b) by 207 days.

(21) Appl. No.: 15/281,482

(22) Filed: Sep. 30, 2016

(65) Prior Publication Data

US 2017/0088348 A1 Mar. 30, 2017

Related U.S. Application Data

(60) Provisional application No. 62/235,095, filed on Sep. 30, 2015.

(51) Int. Cl.

| | |
|---|---|
| ***B65F 1/00*** | (2006.01) |
| ***B65F 1/06*** | (2006.01) |
| *B65F 1/14* | (2006.01) |

(52) U.S. Cl.

CPC ..... *B65F 1/0053* (2013.01); *B65F 1/06* (2013.01); *B65F 1/1473* (2013.01); *B65F 2001/0086* (2013.01); *B65F 2220/101* (2013.01); *B65F 2250/11* (2013.01)

(58) Field of Classification Search

CPC ..... B65F 1/0053; B65F 2001/0086

USPC ..... 220/23.4

See application file for complete search history.

(56) References Cited

U.S. PATENT DOCUMENTS

| | | | |
|---|---|---|---|
| 5,181,297 A | 1/1993 | Andrews, Jr. et al. | |
| 5,184,836 A | 2/1993 | Andrews, Jr. et al. | |
| 8,424,887 B1 * | 4/2013 | LeMeur, Jr. ..... | B60B 33/04 16/18 R |

(Continued)

FOREIGN PATENT DOCUMENTS

| | | |
|---|---|---|
| CN | 203667318 U | 6/2014 |
| WO | WO2015134736 A1 * | 9/2015 |

OTHER PUBLICATIONS

Glaro Four Stream Connectable Recycling Combo 1242-4 (3 Sizes, 29 Color Choices), downloaded from the Internet at: <https://trashcansunlimited.com/four-stream-connectable-recycling-combo-1242-4-3-sizes-29-color-choices/> (applicant admitted prior art).

(Continued)

*Primary Examiner* — Andrew T Kirsch
*Assistant Examiner* — Don M Anderson
(74) *Attorney, Agent, or Firm* — Marshall, Gerstein & Borun LLP

(57) ABSTRACT

A modular waste disposal or recycling container and modular container system are disclosed. The container includes a base and one or more sidewalls extending upwardly from the base. The base and the one or more sidewalls together define an interior space for receiving waste or recyclables. A sidewall of the one or more sidewalls comprises one or more sockets, and each of the one or more sockets is capable of removably receiving a respective one of a magnet, a ferromagnetic insert and a plug with a cap that covers the socket. The modular container system includes at least two containers, one having magnetic properties on a first sidewall and the other having ferromagnetic properties on a second sidewall. When placed adjacent to each other, the first and second sidewalls releasably adhere to each other.

16 Claims, 16 Drawing Sheets

(56) References Cited

U.S. PATENT DOCUMENTS

| | | | | |
|---|---|---|---|---|
| 2010/0237599 | A1* | 9/2010 | Bianchi | A43B 1/0054 280/841 |
| 2011/0000024 | A1* | 1/2011 | Johnson | B25B 15/008 7/118 |
| 2013/0203017 | A1* | 8/2013 | Bambini | A61C 8/0006 433/174 |
| 2015/0336739 | A1* | 11/2015 | Presnell | B65F 1/0053 220/23.83 |

OTHER PUBLICATIONS

R.F. Yamakawa Delta Triangular Plastic Dustbin for Corners, downloaded from the Internet at: <http://www.alibaba.com/product-detail/Delta-triangular-plastic-dustbin-for-corners_131576962.html?spm=a2700.7724838.0.0.ko2JtX> (applicant admitted prior art).

* cited by examiner

MODULAR WASTE CONTAINERS

FIELD

This invention relates generally to modular waste containers and in particular to modular waste containers that can be releasably connected in a modular container system.

BACKGROUND

Society is becoming increasingly aware of a need to take care of the environment. Reducing litter and recycling are some ways humans can reduce their impact on the environment. Waste and/or recycling containers are often set up in public places to facilitate recycling and reducing litter. Sometimes, there is a need to sort between waste and different types of recyclable materials. For this purpose, multiple waste and/or recycling containers might be set up, each container intended to be used for a different type of refuse or recyclable material. For example, there might be one container for paper, another for glass, another for plastics and another for non-recyclable refuse.

SUMMARY

An aspect of embodiments disclosed herein relates to a modular waste disposal or recycling container comprising: a base; and one or more sidewalls extending upwardly from the base, wherein the base and the one or more sidewalls together define an interior space for receiving waste or recyclables, wherein a sidewall of the one or more sidewalls comprises one or more sockets, and wherein each of the one or more sockets is capable of removably receiving a respective one of a magnet, a ferromagnetic insert and a plug with a cap that covers the socket.

In some embodiments, each of the one or more sockets comprises a shape that is complementary to shapes of the respective magnet, the ferromagnetic insert and the plug.

In some embodiments, each of the one or more sockets comprises a threaded bore and any one of the respective magnet, the respective ferromagnetic insert and the respective plug is either screwed into or press fit into the bore.

In some embodiments, either the respective magnet or the respective ferromagnetic insert is screwed into the bore, or the respective plug is press fit into the bore.

In some embodiments, the sidewall has a polygonal shape with a perimeter, wherein the one or more sockets are arranged along the perimeter.

In some embodiments, the sidewall has a rectangular shape, wherein the one or more sockets comprise four sockets, and wherein each of the four sockets is located in a corner of the sidewall.

In some embodiments, the one or more sockets comprise at least two sockets, and the at least two sockets are arranged such that, when each socket receives the respective magnet, the respective magnets lie in a common plane.

An aspect of embodiments disclosed herein relates to a modular system of waste disposal or recycling containers, the system comprising: first and second containers, each container having a base and one or more sidewalls extending upwardly from the base that together define an interior space for receiving waste or recyclables, wherein a first sidewall of the first container includes one or more first magnetic portions, wherein a second sidewall of the second container includes one or more second ferromagnetic portions, and wherein the first and second sidewalls magnetically and releasably adhere to one another when the one or more first magnetic portions are placed adjacent to the one or more second ferromagnetic portions.

In some embodiments, the first sidewall further includes one or more first ferromagnetic portions, and the second sidewall further includes one or more second magnetic portions.

In some embodiments, a first perimeter of the first sidewall contacts a second perimeter of the second sidewall when the one or more first magnetic portions are placed adjacent to the one or more second ferromagnetic portions.

In some embodiments, substantially all of the first and second perimeters contact each other.

In some embodiments, when the one or more first magnetic portions are placed adjacent to the one or more second ferromagnetic portions, the magnetic force between the one or more first magnetic portions and the one or more second ferromagnetic portions causes a flexing of either or both of the first and second sidewalls.

An aspect of embodiments disclosed herein relates to a modular waste disposal or recycling container kit, comprising: a modular waste disposal or recycling container comprising: a base, and one or more sidewalls extending upwardly from the base, wherein the base and the one or more sidewalls together define an interior space for receiving waste or recyclables, wherein a sidewall of the one or more sidewalls comprises one or more sockets, and wherein each of the one or more sockets is capable of removably receiving a respective one of a magnet, a ferromagnetic insert and a plug with a cap that covers the socket; one or more magnets for inserting into the one or more sockets; one or more ferromagnetic inserts for inserting into the one or more sockets; one or more plugs for inserting into the one or more sockets; and a tool for removing a plug of the one or more plugs from a respective socket and for inserting and removing a ferromagnetic insert of the one or more ferromagnetic inserts into a respective socket.

In some embodiments, the tool includes at least one wedge for inserting between the cap of the plug and the sidewall to pry the cap away from the sidewall.

In some embodiments, each of the one or more sockets has a threaded bore, wherein the one or more ferromagnetic inserts are capable of being screwed into the one or more sockets, and wherein the tool includes a hex key portion for screwing in or unscrewing the one or more ferromagnetic inserts.

In some embodiments, the kit further comprises one or more castors, wherein the base is capable of receiving the one or more castors, and wherein the tool includes an open ended wrench portion for adjusting a height of the one or more castors.

In some embodiments, the tool includes at least one wedge for inserting between the cap of the plug and the sidewall to pry the cap away from the sidewall and the at least one wedge is integral with the open ended wrench portion.

An aspect of embodiments disclosed herein relates to a modular system of waste disposal or recycling containers, the system comprising: first and second containers, each container having a base and one or more sidewalls extending upwardly from the base that together define an interior space for receiving waste or recyclables, wherein a first sidewall of the first container includes one or more first magnetic portions, wherein a second sidewall of the second container includes one or more second ferromagnetic portions, and wherein, when the one or more first magnetic portions are placed adjacent to the one or more second ferromagnetic portions, the magnetic force is sufficient to compensate for planar irregularities in the first and second sidewalls in order to reduce a gap between the first and second sidewalls.

Other aspects and features of embodiments of the present disclosure will become apparent to those ordinarily skilled in the art upon review of the following description.

BRIEF DESCRIPTION OF THE DRAWINGS

Examples of embodiments of the invention will now be described in greater detail with reference to the accompanying drawings, in which.

DETAILED DESCRIPTION

Figure 1:
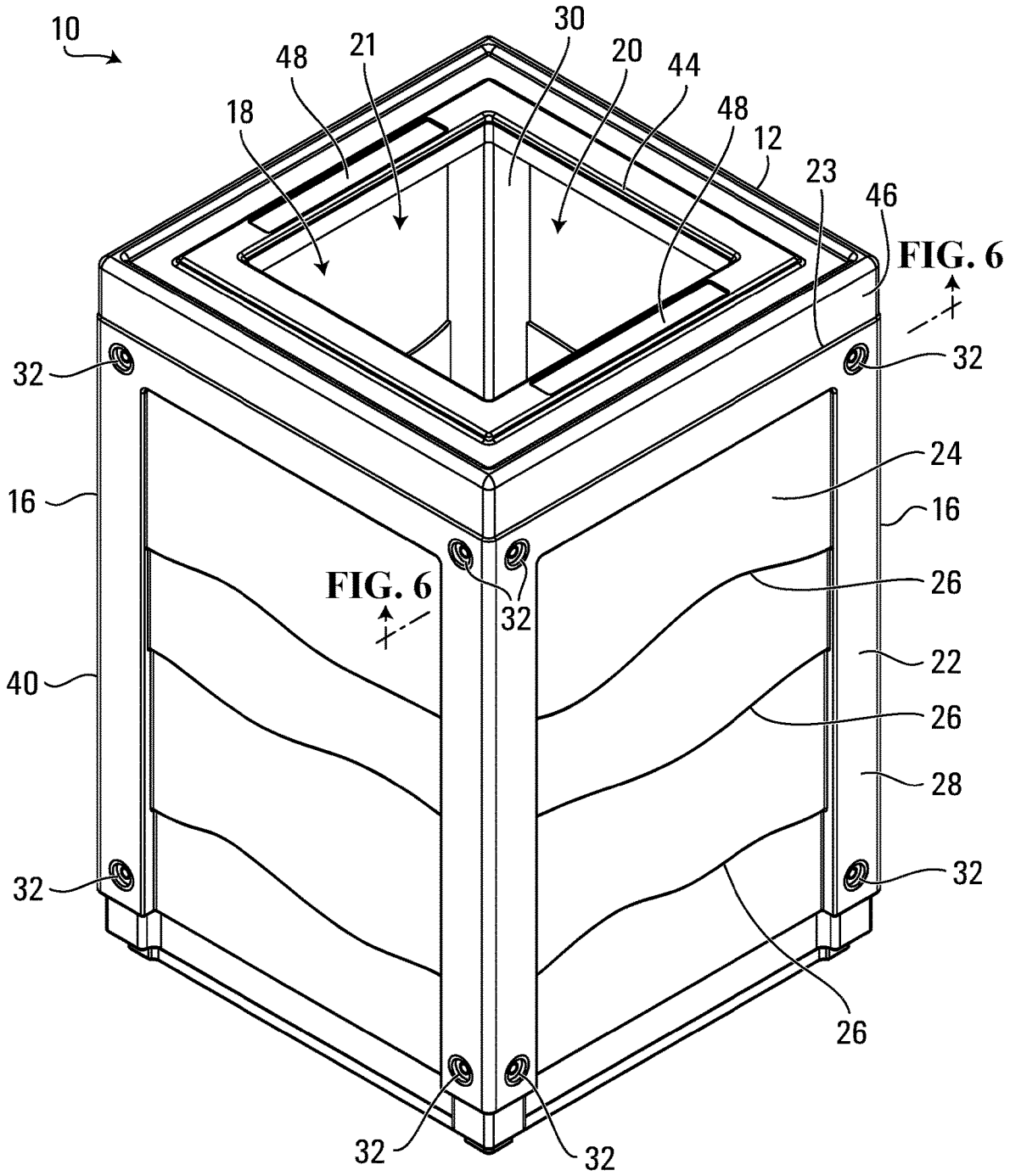
FIG. 1 is a perspective view of a container according to an embodiment of the invention with a cover.
Figure 2:
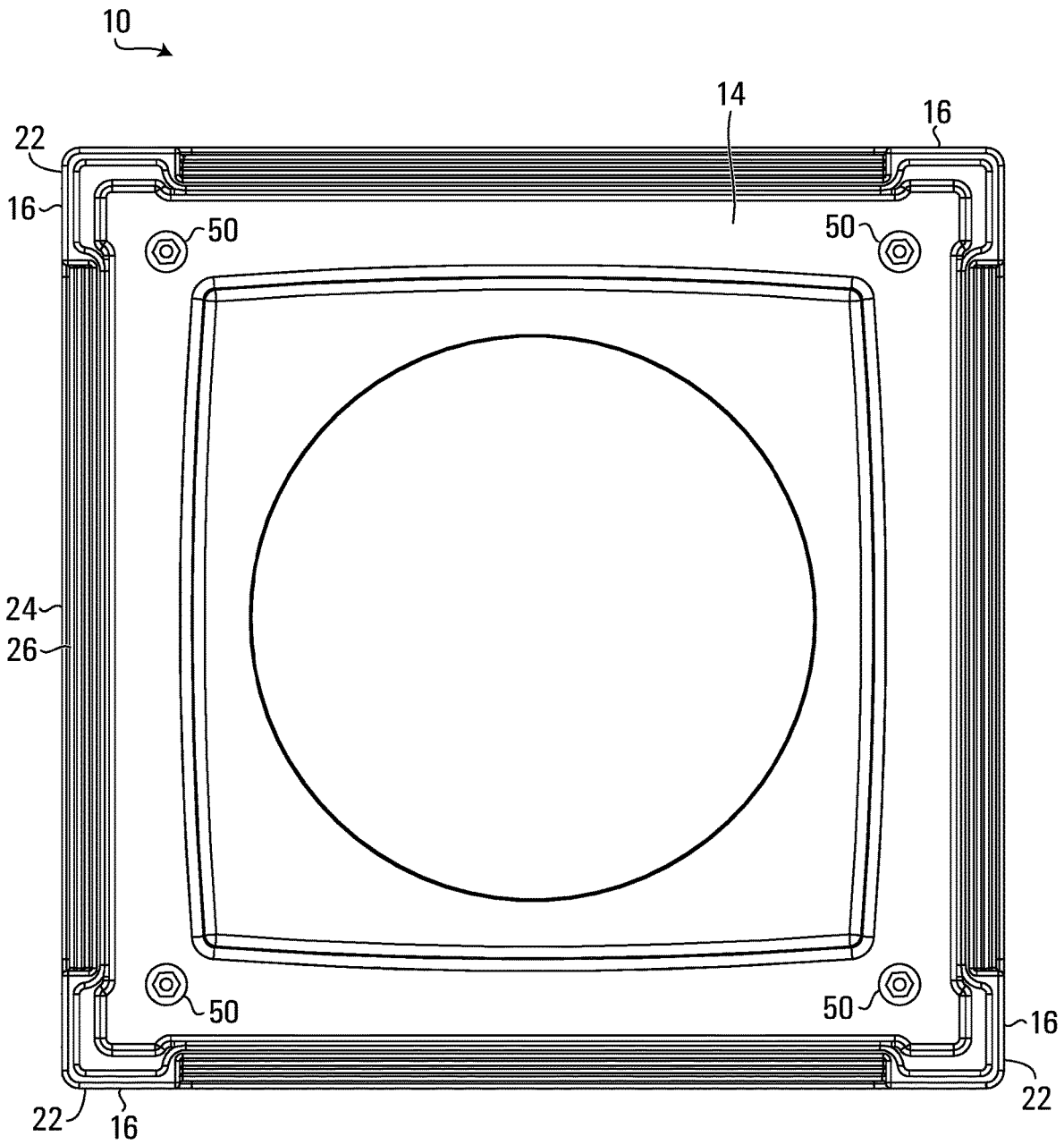
FIG. 2 is a bottom view of the container of FIG. 1.
Figure 3:
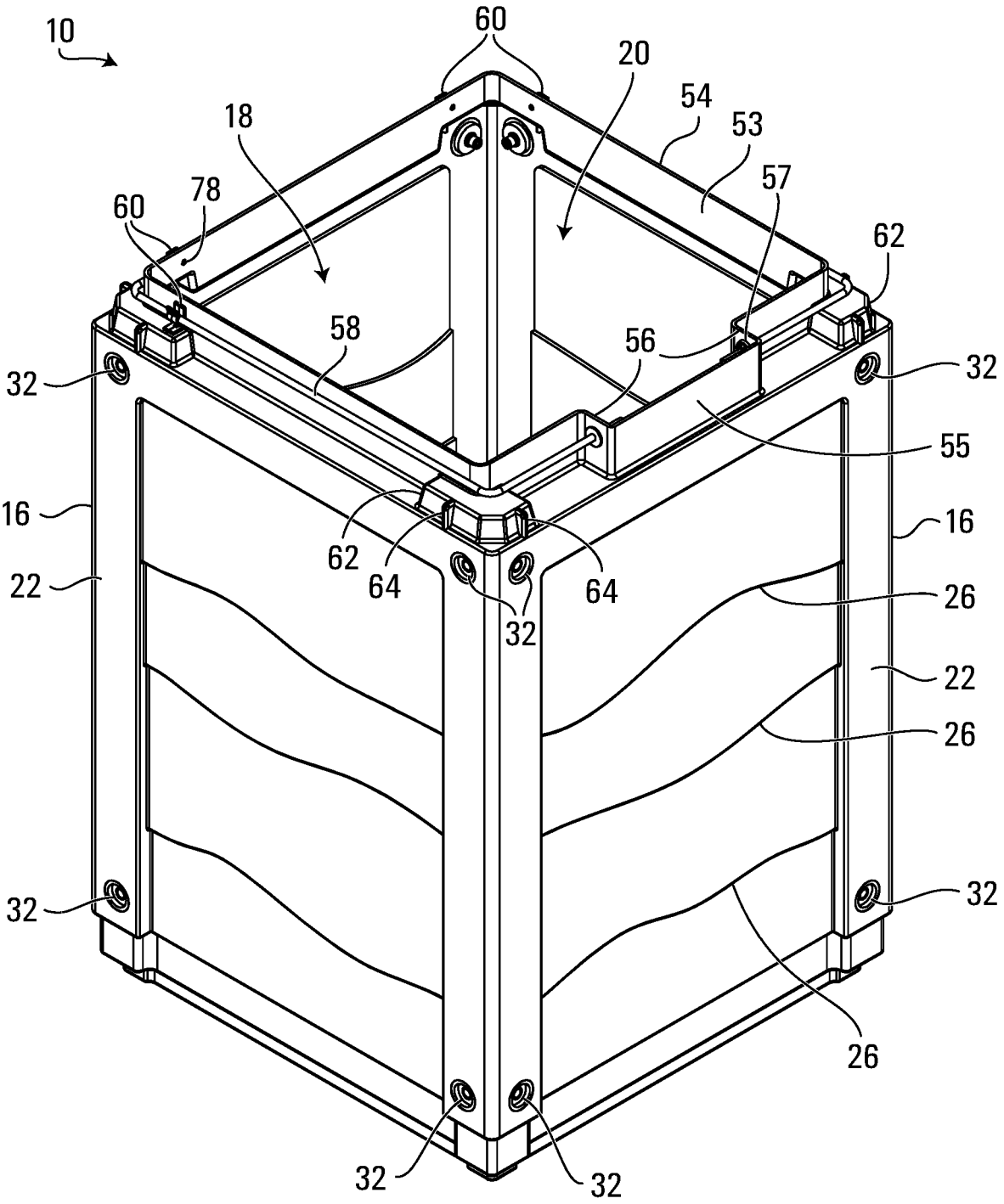
FIG. 3 is a perspective view of the container of FIG. 1 without the cover.

FIGS. 1 to 3 show a waste disposal or recycling container 10 according to an embodiment of the invention. FIG. 1 shows the container 10 with a cover 12. In FIG. 3 the cover 12 has been removed to show additional features of the container 10.

In the embodiment shown, the container 10 has a square base 14 and four, rectangular sidewalls 16 extending upwardly from the base 14. The base 14 and the sidewalls 16 define an interior space 18 of the container 10 for receiving waste or recyclables. The container 10 has an opening 20 at the top, the opening 20 being partially covered by the cover 12. In turn, the cover 12 has an opening 21 that lines up with the opening 20 and through which waste or recyclables can be placed into the container 10. The cover 12 and the opening 21 will be discussed further below.

In some embodiments, the container 10 may have a different number of sidewalls 16 corresponding to a different shape of the base 14. For instance, the base 14 might be circular or oval and there may be a single circular or oval sidewall 16. It is understood that a variety of shapes of the base 14 and corresponding number of sidewalls 16 might be employed.

Moreover, although the sidewalls 16 are shown as rectangular, in yet other embodiments the sidewalls 16 may have a variety of shapes, including other types of polygonal shapes, such as triangular, pentagonal, hexagonal etc. Similarly, in yet other embodiments, each of the sidewalls 16 need not necessarily have the same shape. For instance, one of the sidewalls 16 might be generally planar, while a second of the sidewalls 16 might be curved. Some of the possible different embodiments for the container 10 are shown in FIGS. 14A to 14E, discussed further below.

In yet other embodiments, the sidewalls 16 may have varying heights such that the cover 12 does not rest horizontally on the container 10.

In the embodiment shown in FIG. 1, each of the sidewalls 16 comprises a substantially flat portion 22 that is shaped like an inverted "U" and extends along a portion of a perimeter 23 of the sidewall 16. A series of surfaces 24 are located within the "U" shape of the flat portion 22. The surfaces 24 are inset from the flat portion 22 and have varying edge contours 26. The surfaces 24 are stepped as they extend down the length of each sidewall 16. In other embodiments, the sidewalls 16 may not have any stepped surfaces 24 and/or substantially flat portions 22.

In the embodiment shown, each substantially flat portion 22 has an exterior, outer surface 28, which forms the outermost surface of the sidewall 16, and an interior, inner surface 30 facing the interior 18 of the container 10. In yet other embodiments, the flat portion 22 may be inset from the surfaces 24 and the top surface 24 would form the outermost surface of the sidewall 16.

In other embodiments, the sidewalls 16 may be substantially planar without inset surfaces. In some embodiments, first and second sidewalls 16 may have complementary features. For instance, a first sidewall 16 may include a protrusion or may include concave portions and a second sidewall 16 may have a recess complementary to the protrusion or convex portions complementary to the concave portions. In yet other embodiments, the sidewalls 16 might include both inset portions and protruding portions that are complementary to raised portions and recesses, respectively, on another sidewall 16 or are complementary to each other.

The container 10 includes one or more sockets 32 located on the sidewalls 16, more specifically on the flat portions 22. Each of the sockets 32 is capable of alternatively removably receiving a respective one of a magnet 34, a ferromagnetic insert 36 and a plug 38, embodiments of which will be discussed with respect to FIGS. 8 to 13 in further detail below.

In the embodiment shown in FIG. 1, each of the sidewalls 16 has four sockets located in the substantially flat portion 22. One socket 32 is located near each corner of each of the sidewalls 16. In other embodiments, there may be a different number of sockets 32 and they may be distributed differently. The distribution and arrangement of the sockets 32 may depend on the shape and configuration of the sidewalls 16. For instance, the sockets 32 might be arranged around the perimeter 23 of each of the sidewalls 16. There may be a single socket 32, or a single socket 32 on each of the sidewalls 16. In yet other embodiments, the sockets 32 might be arranged depending on the desired configuration of the magnets 34, ferromagnetic inserts 36 and/or plugs 38. For instance, if two of the sockets 32 are present, they may be arranged such that, when each socket 32 receives a respective magnet 34, the magnets 34 lie in a common plane.

In the embodiments where the sidewalls have varying complementary portions, one or more sockets may be arranged on the complementary portions. For instance, if a sidewall 16 includes a concave portion and another sidewall 16 includes a complementary convex portion, sockets 32 may be located in the concave and convex portions.

As noted above, the cover 12 of the container 10 has the opening 21 through which waste or recyclables can be placed into the container 10. The opening 21 is defined by an inner edge 44 of the cover 12. The size and shape of the inner edge 44 and opening 21 of the cover 12 may vary. For instance, in the recycling industry it is known to use different shapes of openings to differentiate between different types of recyclable items e.g. a round opening for cans or bottles, a slit opening for paper and so on. In some embodiments, the opening 21 of the cover 12 may itself have a cover or lid.

In yet other embodiments, the cover 12 might not have the opening 21 at all and might completely cover and close off the opening 20 of the container 10. Instead, an opening might be formed in one or more of the sidewalls 16. In yet further embodiments, openings may be provided in the cover 12 and the sidewalls 16.

In the embodiment shown, the cover 12 is sized and dimensioned so that when it is placed on the container 10, an exterior perimeter wall 46 of the cover 12 is substantially parallel with and nearly or entirely flush with the flat portions 22 of the sidewalls 16.

The cover 12 may include areas 48 on which writing or other descriptive material can be included to indicate, for example, what type of waste or recyclable materials should be placed in the container 10.

Figure 18:
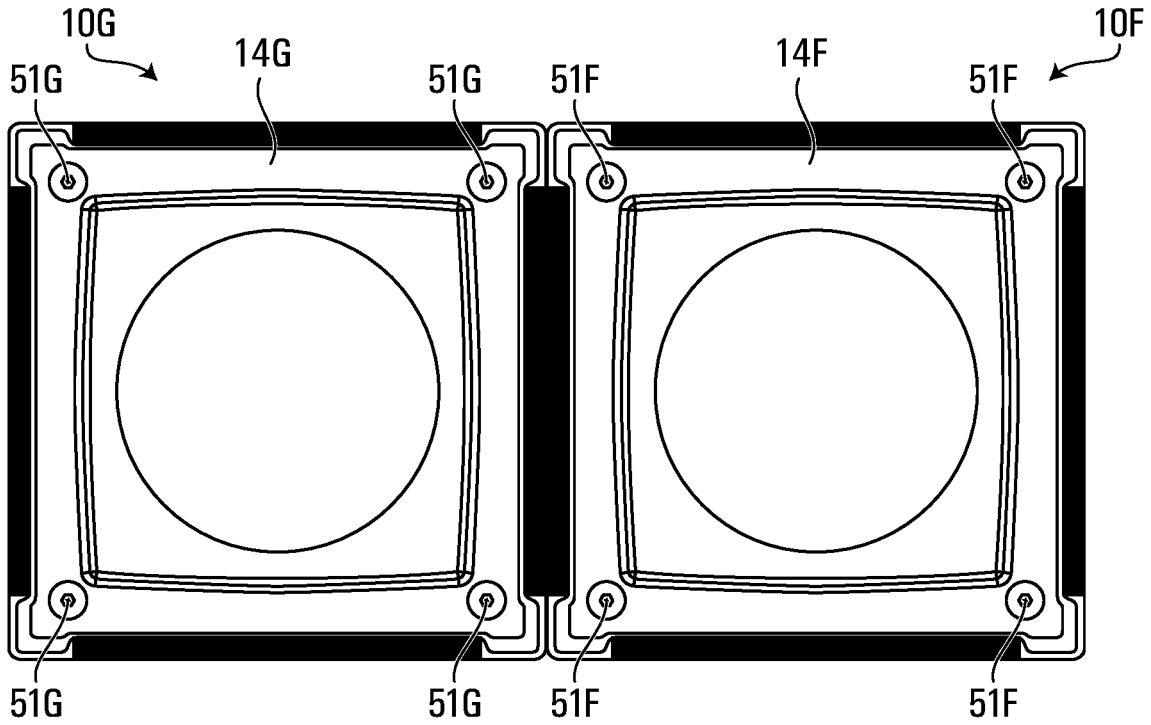
FIG. 18 is a bottom view of the modular container system of FIG. 16 with feet installed.
Figure 19:
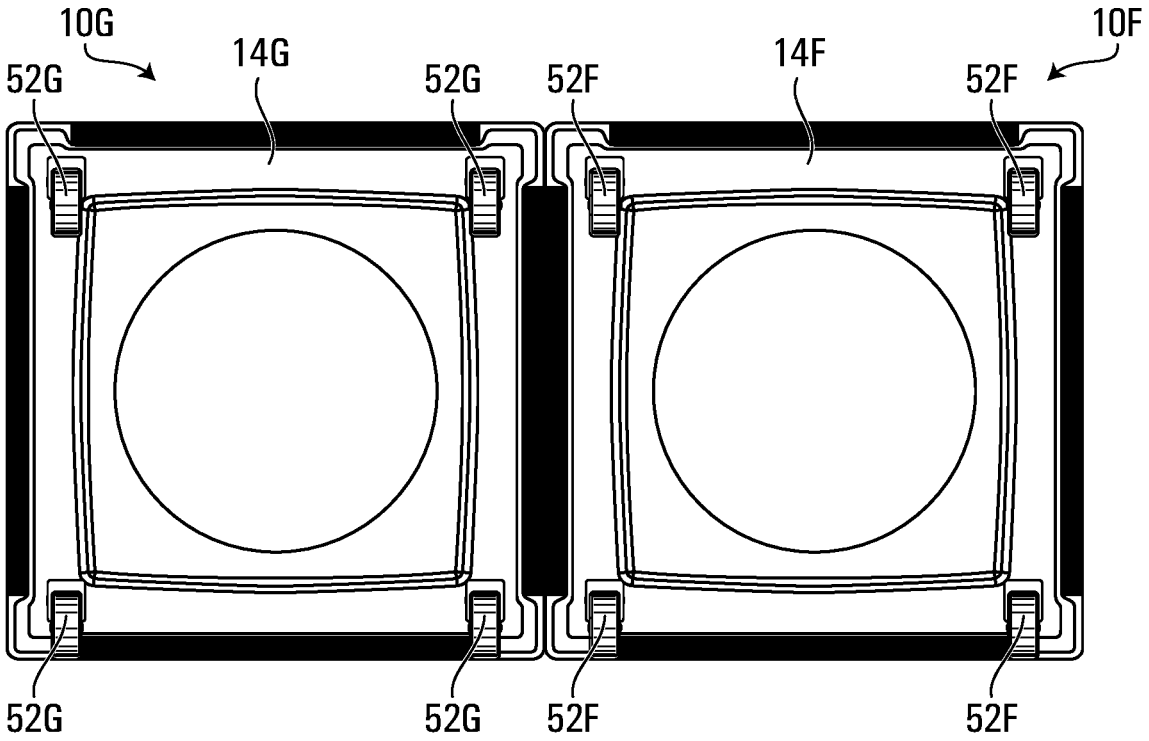
FIG. 19 is a bottom view of the modular container system of FIG. 16 with castors installed.

As best shown in FIG. 2, in this embodiment, the base 14 of the container 10 includes four bushings 50 which are capable of receiving feet 51 or castors 52 (shown in FIGS. 18 and 19, respectively) for supporting the container. However, this is not necessary and the container can also stand on the floor without the additional feet 51 or castors 52. The number of the bushings 50 may vary or they may be omitted entirely.

In the embodiment shown, the bushings 50 are located near each corner of the base 14. In other embodiments, a different arrangement of the bushings 50, and thus the feet 51 or the castors 52, if used, is possible.

Figure 4:
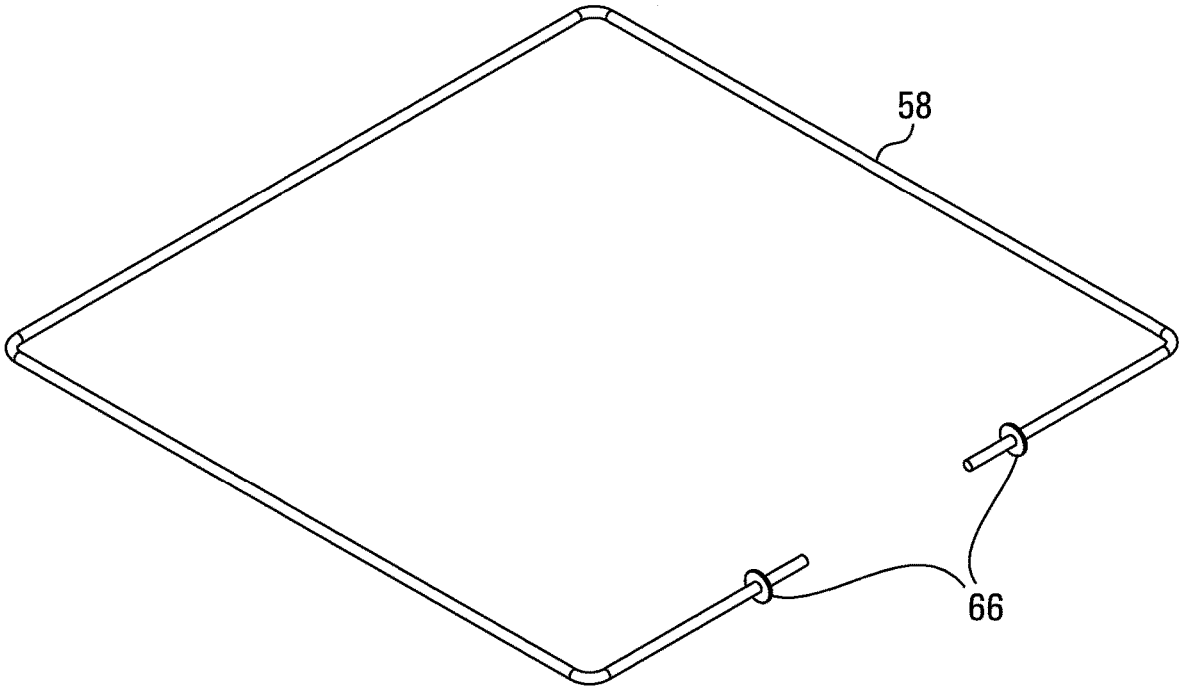
FIG. 4 is a perspective view of a bag retaining wire according to an embodiment of the invention.
Figure 5:
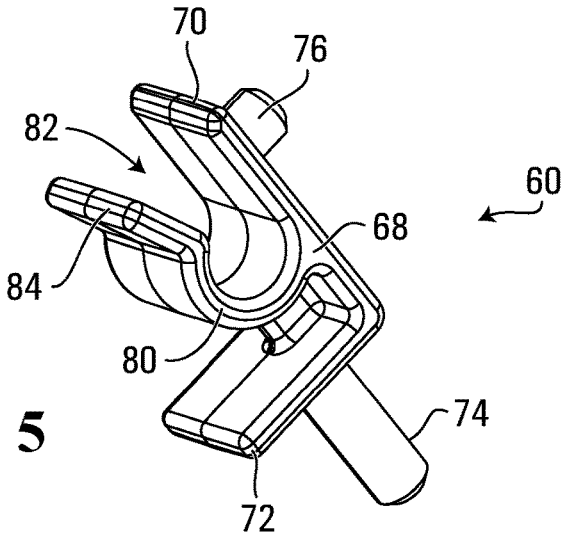
FIG. 5 is a perspective view of a clip according to an embodiment of the invention.

As depicted in FIGS. 3 to 5, this embodiment of the container 10 includes a cover supporting wall 53, which extends around the opening of the container 10. The cover supporting wall 53 is inset from the outer surfaces 28 of the flat portions 22 and includes an upper lip 54. The cover 12 rests on the upper lip 54.

A hinge portion 55 of the cover supporting wall 53 is less inset from outer surfaces 28 than the remainder of the cover supporting wall 53. The hinge portion 55 is connected to the remainder of the cover supporting wall 53 via two connecting wall portions 56. Each connecting wall portion 56 includes a pivot hole 57 to receive ends of a bag retaining wire 58. The bag retaining wire 58 extends around the cover supporting wall 53 and is retained by wire clips 60 located on a side of the container 10 opposite from the hinge portion 55.

In the embodiment shown, the container 10 further includes raised centering portions 62 that extend around each corner of the cover supporting wall 53. Centering ribs 64 jut out from the centering portions 62. The centering portions 62 and the centering ribs 64 help to center the cover 12 over the opening 20 of the container 10 and to limit lateral movement of the cover 12. In particular, due to the inset of the cover supporting wall 53 from the outer surfaces 28, when the cover 12 rests on the upper lip 54 a gap (not shown) is present between the cover supporting wall 53 and the outer perimeter wall 46 of the cover 12. Without centering portions 62 and centering ribs 64, this gap would allow the cover 12 to shift laterally while resting on the upper lip 54. However, this gap is substantially occupied by centering portions 62 and centering ribs 64, thus limiting the amount of space the cover 12 has to shift laterally while resting on the upper lip 54.

In some embodiments, the cover supporting wall 53 might have a different configuration or may be omitted entirely. For instance, the cover 12 may rest on a number of individual protrusion extending from the sidewalls 16 or on the sidewalls 16 themselves.

Referring to FIG. 4, the bag retaining wire 58 is configured to have a shape that surrounds and is spaced apart from the cover supporting wall 53 and the opening 20 of the container 10. Thus, in other embodiments where the cover supporting wall 53 and/or the opening 20 have a different shape, e.g. circular or oval, the bag retaining wire 58 would also have a different shape, e.g. circular or oval.

In yet other embodiments, the shape of the bag retaining wire 58 may be different from the shapes of the cover supporting wall 53 and/or the opening 20.

The bag retaining wire 58 includes two guards 66, one near either end of the bag retaining wire 58, which prevent the bag retaining wire 58 from travelling further than desired into the pivot holes 57 in the hinge portion 55.

The bag retaining wire 58 is sufficiently flexible to allow it to be flexed so that the ends of the bag retaining wire 58 can be inserted into the pivot holes 57 in the hinge portion 55. The material for the bag retaining wire 58 may be chosen to provide, inter alia, such flexure.

FIG. 5 depicts an embodiment of the wire clip 60 used to secure the bag retaining wire 58. The clip 60 includes an "L"-shaped body 68 with a back 70 and a bottom 72. A first stud 74 extends from the bottom 72. A second stud 76 extends from the back 70. The first and second studs 74, 76 are inserted into corresponding clip apertures 78 in the container 10 until the back 70 and the bottom 72 contact corresponding surfaces on the cover supporting wall 53 and centering portions 62, respectively. The clip 60 is then fixed in place using a fastener (not visible) from underneath on the first stud 74.

The clip 60 also includes a curved wire retaining portion 80 that is sized to complement a diameter of the bag retaining wire 58. The wire retaining portion 80 has a mouth 82, which receives the bag retaining wire 58 when it is inserted into the clip 60. The mouth 82 is formed between the back 70 and an angled tab 84 that extends from one end of the wire retaining portion 80 at an angle away from the back 70 so that the mouth 82 narrows towards the wire retaining portion 80. The angled tab 84 serves to guide the bag retaining wire 58 into the mouth 82 as it is being inserted.

The width of the narrow end of the mouth 82 is less than the diameter of the bag retaining wire 58 such that the bag retaining wire 58 causes the clip 60 to flex to accommodate the bag retaining wire 58 as it passes through the narrower end of the mouth 82. Once past the narrower end of the mouth 82, the clip flexes back, either fully or partially, securely holding the bag retaining wire 58 in the wire retaining portion 80.

To secure a bag (not shown) into the interior of the container 10 to collect waste or recyclables, a user would remove the cover 12 and lift the bag retaining wire 58 until it snaps out of the clips 60, pivoting it about the hinge portion 55 until it clears the area surrounding the cover supporting wall 53. The bag, such as a garbage bag or the like, would be placed into the interior of the container 10 and the edges of the bag would be wrapped around the bag retaining wire 58 before the bag retaining wire 58 would be lowered and snapped back into the clips 60. The cover 12 would then be replaced.

Conversely, in order to remove a bag, the cover 12 would be removed, the bag retaining wire 58 lifted upwards, the old bag removed and the new bag secured, as described above.

Figure 6:
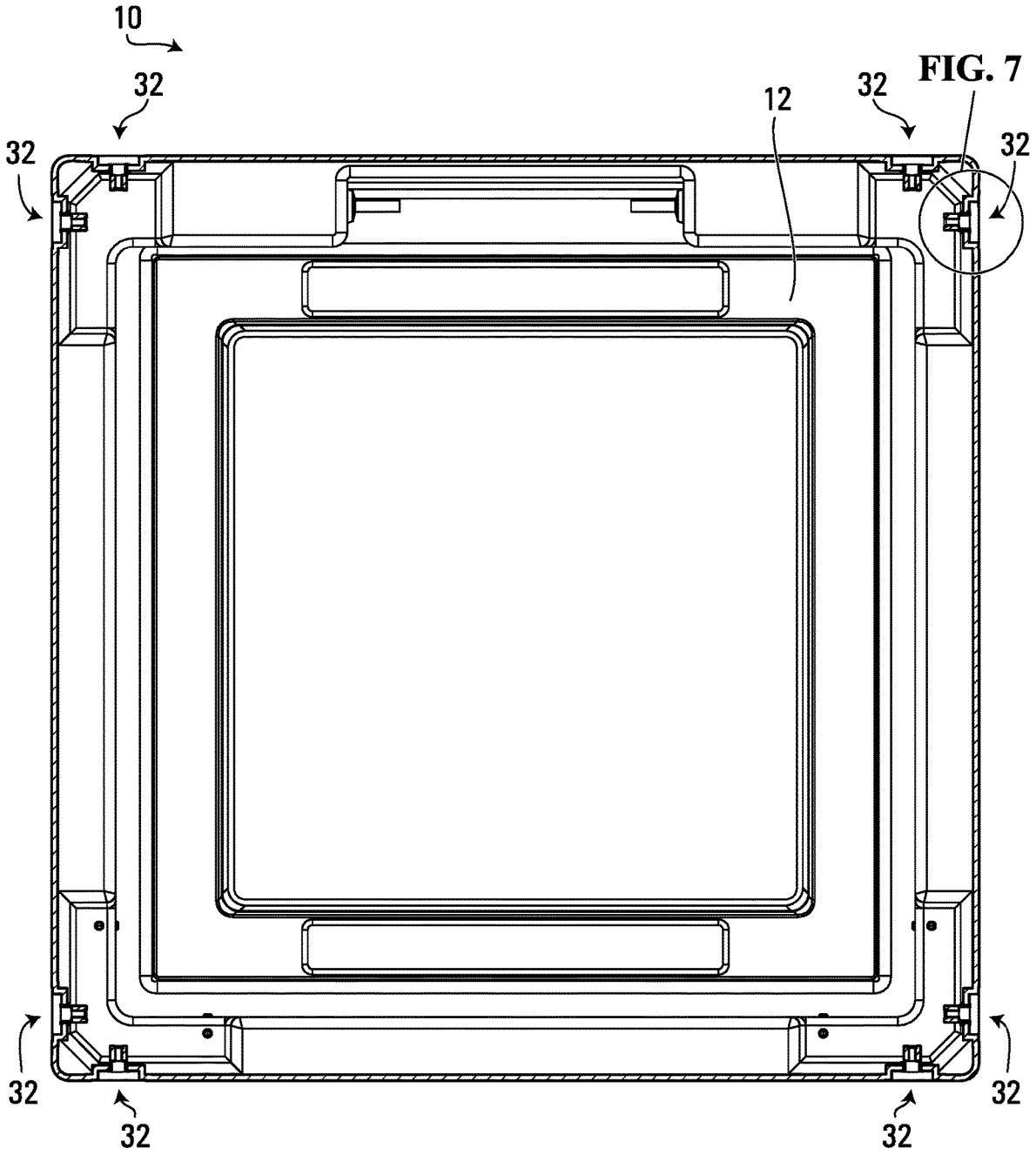
FIG. 6 is a cross-sectional view of the container of FIG. 1 taken along line 6-6.

FIG. 6 depicts a cross-sectional view of the container 10 taken along line 6-6 in FIG. 1. FIG. 6 depicts the detail of a number of the sockets 32, one of which is enlarged in FIG. 7.

Figure 7:
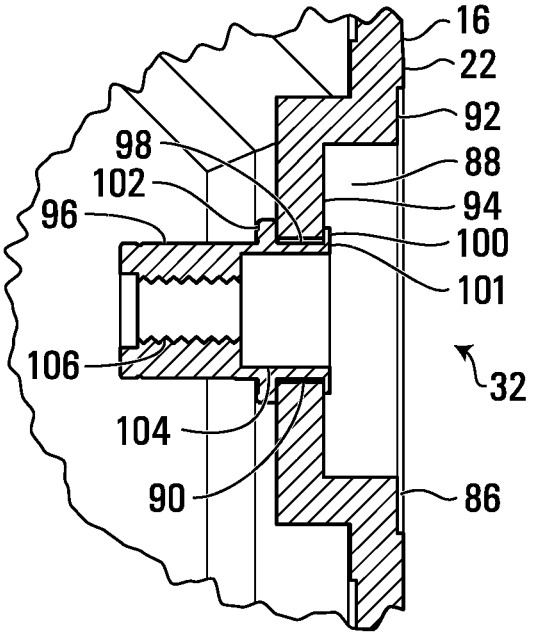
FIG. 7 is an enlarged view of a portion of the container of FIG. 1.

Referring now to FIG. 7, the features of one embodiment of a socket 32 will be described. It is to be understood that the term "socket" encompasses any type of hollow which may receive the magnet 34, the ferromagnetic insert 36 or the plug 38. The term "socket" does not necessarily require that there be an indentation or other kind of recess in the sidewall 16. For instance, in some embodiments, the socket 32 may simply comprise an aperture extending through the sidewall 16 or a hollow or a hole in a protruding or raised portion of the sidewall 16.

In the embodiment shown, the socket 32 is comprised of a first circular recess 86 and a second circular recess 88, both formed in the sidewall 16, and a bushing aperture 90 that extends through the sidewall 16. The first recess 86, the second recess 88 and the bushing aperture 90 are all concentric. A diameter of the second recess 88 is smaller than a diameter of the first recess 86 and a diameter of the bushing aperture 90 is smaller than the diameter of the second recess 88.

The first recess 86 includes a substantially flat contact surface 92 that is substantially parallel with portions of the outer surface 28 and the inner surface 30 surrounding the socket 32 and the bushing aperture 90, respectively. The second recess 88 includes a substantially flat surface 94 that is substantially parallel to the contact surface 92.

In the embodiment shown, a crimp bushing 96 is installed in the bushing aperture 90. The crimp bushing 96 includes an annular channel 98 that receives the sidewall 16 surrounding the bushing aperture 90. First and second annular clamping protrusions 100, 102 on either side of the sidewall 16 clamp the sidewall 16 between them and hold the crimp bushing 96 in place. Clamping protrusion 100 includes an annular contact surface 101 that faces the second recess 88.

Before installation of the crimp bushing 96, the second clamping protrusion 102 is not present. The uninstalled crimp bushing 96 is inserted into the bushing aperture 90. The crimp bushing 96 is then mechanically deformed or crimped to form the second clamping protrusion 102, thus clamping the sidewall 16.

The crimp bushing 96 includes first and second concentric bores 104, 106. The first bore 104 is not threaded and extends only a portion of the length of the crimp bushing 96. The first bore 104 may facilitate crimping of the crimp bushing 96. The second bore 106 is threaded and has a diameter smaller than the first bore 104 and extends through the crimp bushing 96.

In embodiments where the container 10 is formed by moulding, instead of installing a bushing after moulding, the bushing may be placed at the desired location in the tool used to mould the container before the moulding process. Thus, when the container 10 is formed, material that forms sidewall 16 would flow over and cover at least some of the part of the bushing that extends into container 10. This may aid in retaining the bushing in place. Thus, in these embodiments, the clamping protrusions 100 and/or 102 may not be present. Having the container form around the bushing during the moulding process rather than installing the bushing in the container 10 after moulding, may aid in improving tolerances, thereby helping to ensure that the sockets 32 line up with corresponding sockets 32 on another container 10, as discussed below.

According to the embodiment shown, either the magnet 34 or the ferromagnetic insert 36 can be screwed into the second bore 106 and can thus be received in the socket 32. Alternatively, the plug 38 can be inserted into the second bore 106 with a press fit and thus also received in the socket 32.

In other embodiments, other means of receiving the magnet 34, the ferromagnetic insert 36 and the plug 38 in a respective socket 32 might be employed. In some embodiments, the magnet 34 and ferromagnetic insert 36 may also be press fit into the second bore 106. In yet other embodiments, the socket 32 may have a separate bore for each of the magnet 34, the ferromagnetic insert 36 and the plug 38 to be either screwed in or press fitted in. In some embodiments, other connecting or fastening means, such as a hook and loop system, might be employed to releasably secure the magnet 34, the ferromagnetic insert 36 and/or the plug 38 in the socket 32. In some embodiments, adhesive may be used as connecting means. If adhesive is used, a solvent may be used to dissolve the adhesive.

Referring to FIGS. 8 to 13, the magnet 34, ferromagnetic insert 36 and plug 38 will now be described in more detail.

Figure 8:
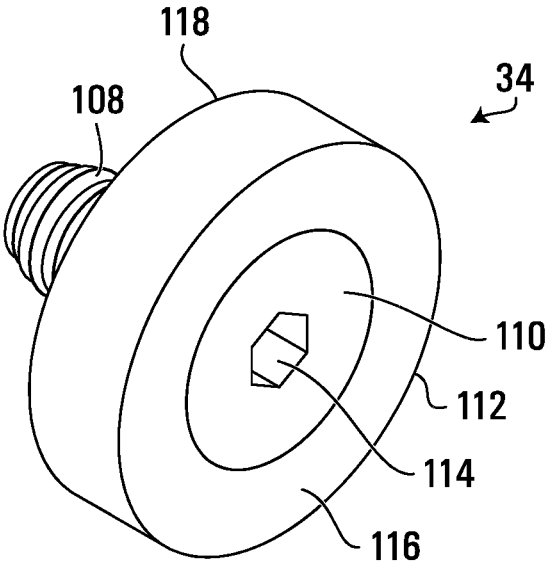
FIG. 8 is a perspective view of a magnet according to an embodiment of the invention.
Figure 9:
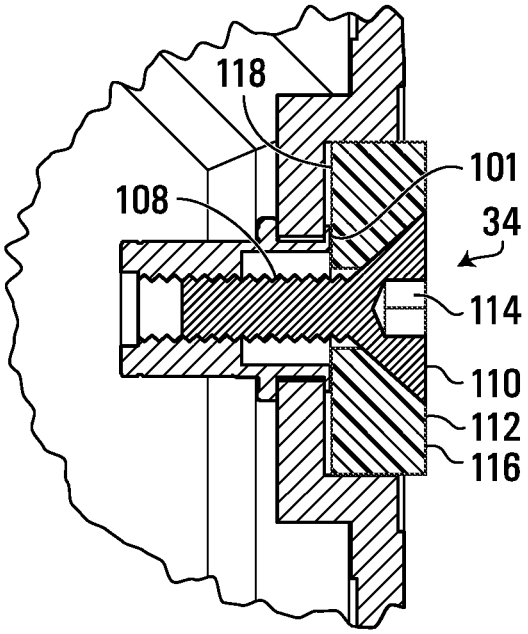
FIG. 9 is an enlarged view of a portion of the container of FIG. 1 with a magnet inserted.

As depicted in FIGS. 8 and 9, in the embodiment shown, the magnet 34 includes a threaded bolt portion 108 with a bolt head 110 and a cylindrical magnetic ring 112 attached to the bolt head 110. In some embodiments, the magnetic ring 112 may be attached to the bolt portion 108. The magnetic ring 112 may be attached to the bolt portion 108 and/or the bolt head 110 in various ways. The magnetic ring 112 may be screwed on, welded on, or adhered to the bolt portion 108 and/or the bolt head 110. The magnetic ring 112 may be attached with a positive locking interference or shrink fit to the bolt portion 108 and/or the bolt head 110.

In the embodiment shown, the bolt head 110 includes a hex socket 114 which can receive a correspondingly sized hex tool in order to screw the bolt portion 108 into the second bore 106.

The magnetic ring 112 includes a flat exterior face 116 that remains visible on the exterior of the container 10 after the magnet 34 is received by the socket 32. In the embodiment shown, the flat exterior face 116 is flush with a flat top of the bolt head 110. In other embodiments, the bolt head 110 may be inset from the exterior face 116 or may protrude with respect to the face 116.

The magnetic ring 112 also includes a flat interior face 118 that contacts the contact surface 101 when the magnet 34 is received in the socket 32. In the embodiment shown, the outer diameter of the magnetic ring 112 is sized to be smaller than or equal to the diameter of the second recess 88.

Although the term "magnet" is used here to refer to the combination of the bolt portion 108, the bolt head 110 and magnetic ring 112, it is to be understood that the bolt portion 108 and/or the bolt head 110 do not necessarily have magnetic properties. The bolt portion 108 and/or the bolt head 110 might be made, for instance, from steel commonly used to make bolts or screws, with the magnetic ring 112 being attached to the bolt portion 108 and/or bolt head 110 as described above. Conversely, in other embodiments, the bolt portion and magnetic ring might be formed integrally from a magnetic material.

The magnet 34 may be made of a variety of magnetic materials. In one embodiment, the magnet 34 is a rare earth magnet.

Figure 10:
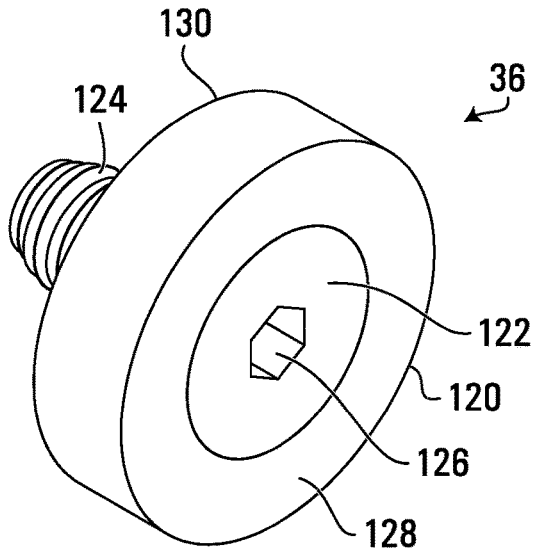
FIG. 10 is a perspective view of a ferromagnetic insert according to an embodiment of the invention.
Figure 11:
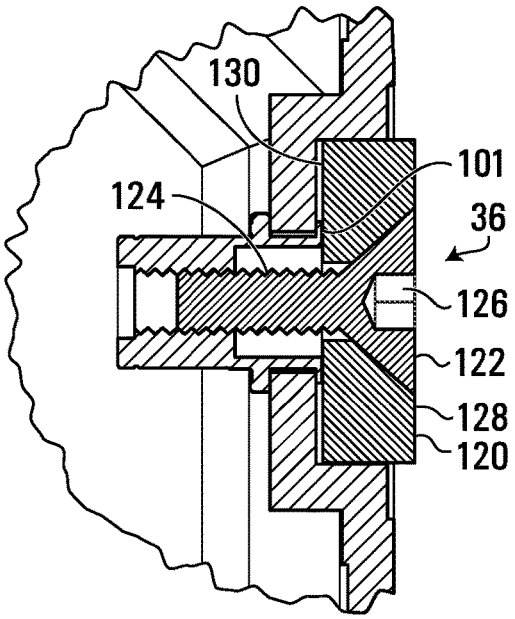
FIG. 11 is an enlarged view of a portion of the container of FIG. 1 with a ferromagnetic insert inserted.

Referring to FIGS. 10 and 11, in the embodiment shown, the ferromagnetic insert 36 is configured very similar to the magnet 34 but includes a ferromagnetic ring 120 attached to a bolt head 122. The ferromagnetic ring 120 may also be attached to a threaded bolt portion 124. The ferromagnetic ring 120 may be attached to the bolt portion 124 and/or the bolt head 122 in various ways. The ferromagnetic ring 120 may be screwed on, welded on, or adhered to the bolt portion 124 and/or the bolt head 122. The ferromagnetic ring 120 may be attached with a positive locking interference or shrink fit to the bolt portion 124 and/or the bolt head 122.

In some embodiments, the bolt head 122 of the ferromagnetic insert 36 also includes a hex socket 126 which can receive a correspondingly sized hex tool in order to screw the bolt portion 124 into the second bore 106.

In the embodiment shown, similar to the magnetic ring 112, the ferromagnetic ring 120 includes a flat exterior face 128 that remains visible on the exterior of the container 10 after the ferromagnetic insert 36 is received in the socket 32. In the embodiment shown, the flat exterior face 128 of the ferromagnetic ring 120 is flush with a flat top of the bolt head 122. In other embodiments, the bolt head 122 may be inset from the face 128 or protrude with respect to the face 128.

In the embodiment shown, the ferromagnetic ring 120 also includes a flat interior surface 130 that contacts the second contact surface 94 when ferromagnetic insert 36 is received by the socket 32. An outer diameter of the ferromagnetic ring 120 is sized to be smaller than or equal to the diameter of the second recess 88. In the embodiment shown, the outer diameter of the ferromagnetic ring 120 is substantially the same as the outer diameter of the magnetic ring 112.

The ferromagnetic insert 36 and/or the ferromagnetic ring 120 may be made of any suitable ferromagnetic metal such as ferritic stainless steel. As in the case of the magnet 34, in some embodiments, the entire ferromagnetic insert 36 may be integrally formed of a single piece of material.

Figure 12:
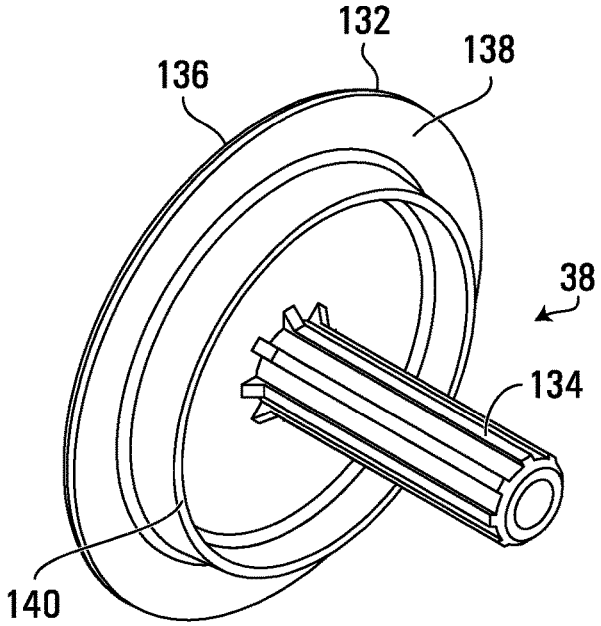
FIG. 12 is a perspective view of a plug according to an embodiment of the invention.
Figure 13:
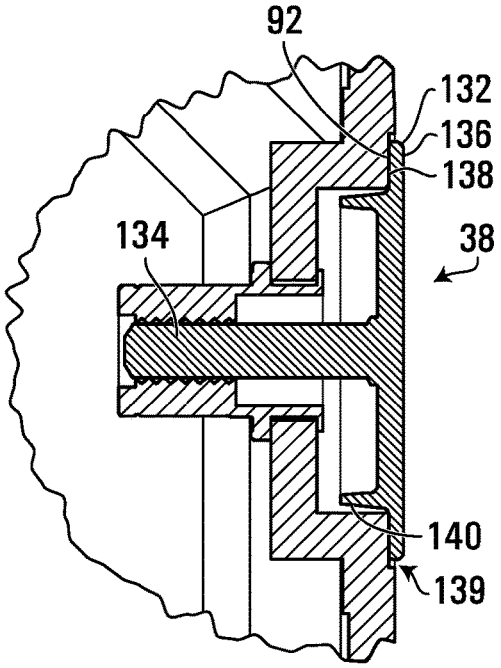
FIG. 13 is an enlarged view of a portion of the container of FIG. 1 with a plug inserted.

Referring to FIGS. 12 and 13, in the embodiment shown, the plug 38 includes a circular cap 132 connected to a shaft 134. The cap 132 has an exterior surface 136 that remains visible on the exterior of the container 10 when the cap 132 is received in the socket 32. The cap 132 also has an undersurface 138 that contacts the contact surface 92 when the plug 38 is received in the socket 32. A diameter of the cap 132 is sized such that it is smaller than the diameter of the first recess 86 but large enough to cover and close off the second recess 88. Furthermore, the diameter of the cap 132 is sized such that a narrow, circular gap 139 is formed between the sidewall 16 surrounding the first recess 86 and the cap 132.

The shaft 134 is ribbed and sized to be press fit into the second bore 106. A positioning ring 140 extends from the undersurface 138 and has an outer diameter sized smaller than the diameter of the second recess 88 such that a tolerance between the two is sufficiently small to limit or prevent movement of the plug 38 in a direction perpendicular to a longitudinal axis of the shaft 134 when the plug 38 is received in the socket 32.

The plug 38 may be made of a variety of materials, including thermoplastics.

It is to be understood that other embodiments of the magnets 34, ferromagnetic inserts 36 and plugs 38 are possible as well. For example, any one of the magnet 34, the ferromagnetic insert 36 and the plug 38 may be either screwed into or press fit into the bore.

In some embodiments, either or both of the magnet 34 and the ferromagnetic insert 36 could be configured as a disk or plate of various shapes that is temporarily attached to, inserted in or connected to the socket 32. Accordingly, the scokets 32 may also take on a variety of desired shapes, which, in some embodiments, may be complementary to the shapes of the magnet 34, ferromagnetic insert 36 and/or plug 38.

In yet other embodiments, the magnet 34 and the ferromagnetic insert 36 could be configured to include complementary shapes. For example, the magnet 34 might have a magnetic protrusion, while the ferromagnetic insert 36 would have a complementarily shaped ferromagnetic recess or aperture, or vice versa.

In one embodiment, the magnet 34 and, in particular, the magnetic ring 112, may be sized so that after being received in the socket 32 the face 116 is recessed and inset from the outer surface 28 of the sidewall 16. In such an embodiment, the ferromagnetic insert 34 and, in particular, the ferromagnetic ring 120, may be sized to protrude beyond the outer surface 28 and to fill the recess created by insetting the magnet 34. It is understood that the opposite configuration, with the magnet 34 protruding and the ferromagnetic insert 36 being recessed, is also possible in some embodiments.

In some embodiments, the plug 38 may also be configured to be screwed into the second bore 106. In other embodiments, the shaft 134 may be omitted and the plug 38 could be configured as only the cap 132 with the positioning ring 140 being press fit into a corresponding recess in the socket 32. In yet other embodiments, the plug 38 could be configured similar to a screw on lid but with an external thread that is screwed on to a corresponding internal thread in the socket 32.

In view of the foregoing, it also to be understood that other embodiments of the sockets 32 are possible. In some embodiments, differently configured sockets may be provided, each socket intended to receive either the magnet 34 or the ferromagnetic insert 36, as well as the plug 38. In some embodiments, including the embodiment depicted in the figures, the sockets 32 could be configured to have a shape that is complementary to shapes of each of the respective magnet 34, the ferromagnetic insert 36 and the plug 38, thus allowing the magnet 34, the ferromagnetic insert 36 and the plug 38 to be alternatively removably received in the socket 32. Such a shape could include recesses, bores, apertures, protrusions, insets, and other mating features, or combinations thereof. For instance, in the embodiment depicted in the figures, the shape includes a combination of circular recesses and bores. However, it is to be understood that the shape of the sockets 32 is not limited to the embodiment depicted. For example, in some embodiments, the socket 32 may simply comprise an aperture in a sidewall 16 of the container 10 for receiving a fastener, without any recesses. In such an embodiment, the magnet 34, ferromagnetic insert 36 and the plug 38, would project outword from the sidewall 16 and would not be recessed FIGS. 14A to 14E depict further embodiments of the waste disposal or recycling container. In FIGS. 14A to 14E, the letters "A", "B", "C", etc. have been added to the reference numerals to denote parts that correspond to the parts of container 10 in FIGS. 1 to 13. As can be seen in FIGS. 14A to 14E, numerous different shapes and configurations of a container are possible. However, it is to be understood that shapes and configurations not depicted in the figures are also possible.

Figure 14A:
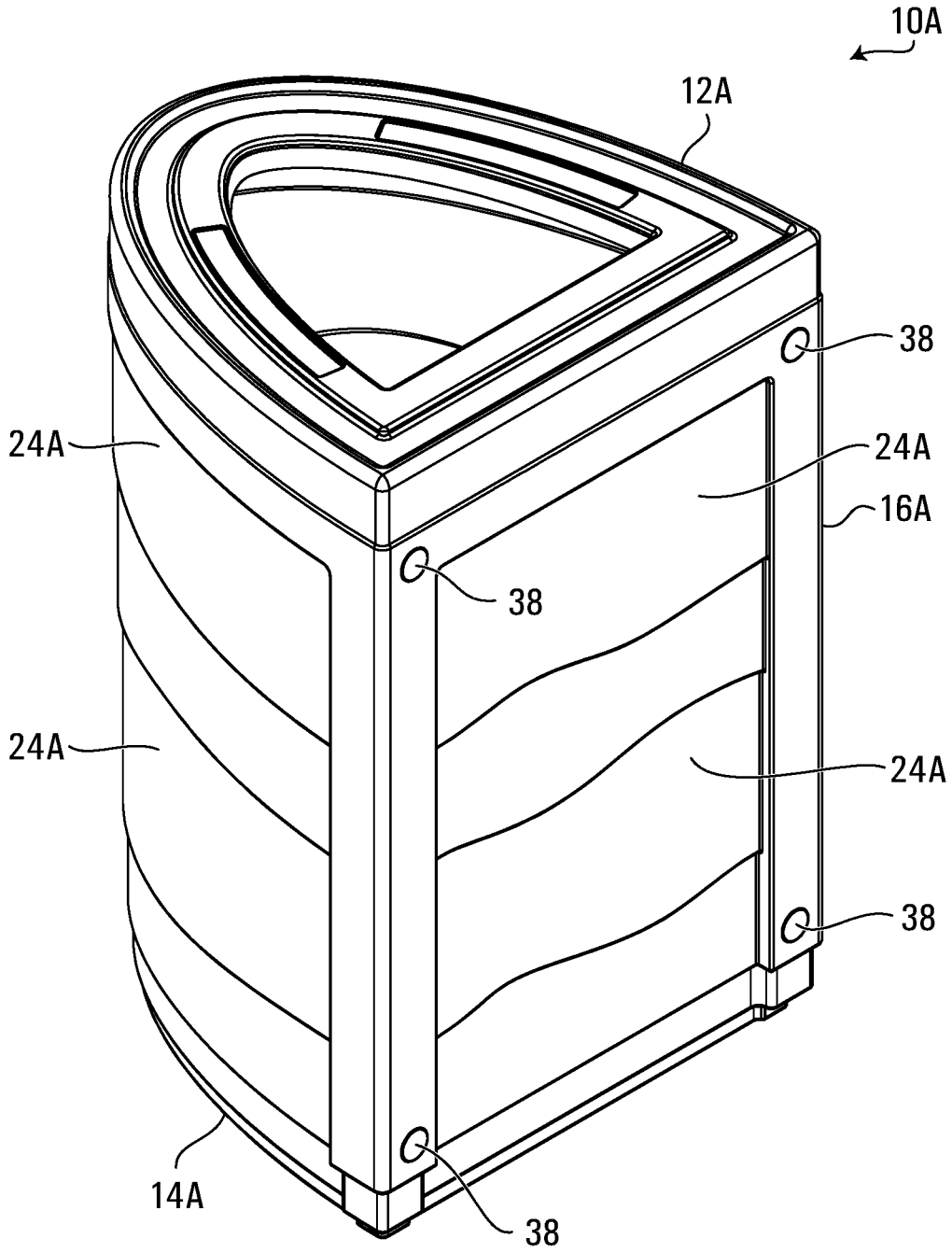
FIGS. 14A to 14E are perspective views of containers according to further embodiments of the invention.

In FIG. 14A, the container 10A includes two sidewalls 16A, a first, end sidewall and a second, curved sidewall that has a profile of a semi-ellipse. The sockets 32 are found only on the first sidewall and are depicted with the plugs 38 inserted. The cover 12A has a shape and size corresponding to the base 14A and the sidewalls 16A.

Figure 14B:
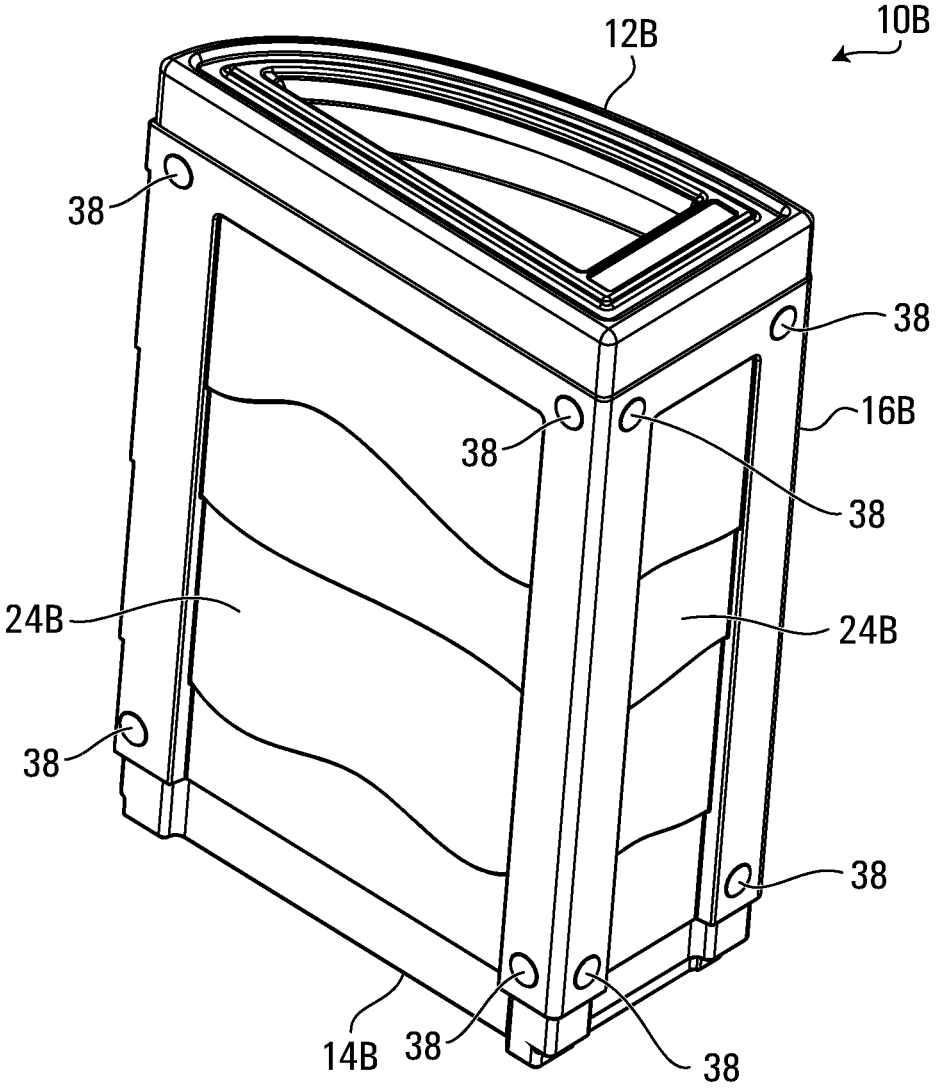

In FIG. 14B, the container 10B includes three sidewalls 16B, two sidewalls that intersect at a right angle and a third, curved sidewall. Sockets 32, which are depicted with the plugs 38 inserted, are found on the first two sidewalls and not on the curved sidewall.

Figure 14C:
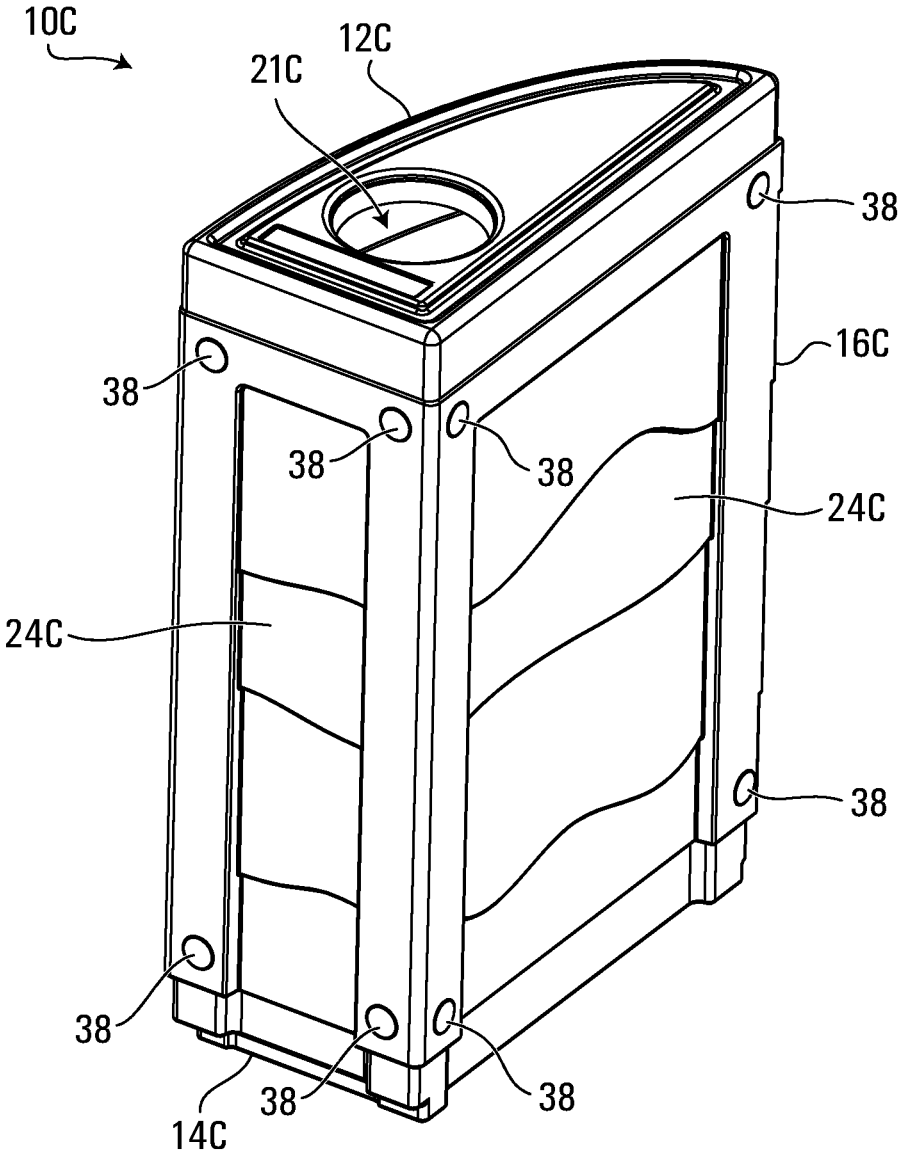

In FIG. 14C, the container 10C has a shape similar to the container 10B in FIG. 14B. However, the cover 12C is configured differently in that the opening 21C is smaller than in the configuration shown in FIG. 14B. The opening 21C in FIG. 14C is circular and by its shape may indicate to a user that only cans or bottles should be placed into the container.

Figure 14D:
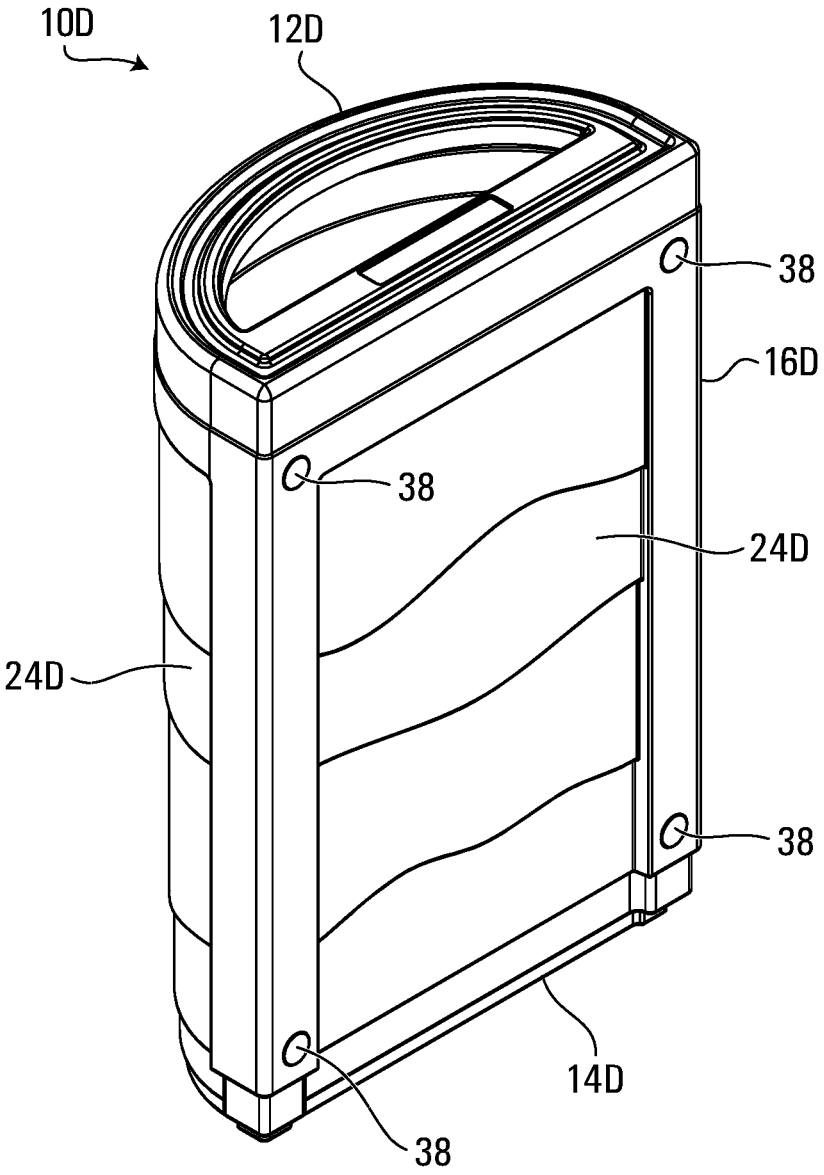

In FIG. 14D, the container 10D also has only two sidewalls 16D similar to the container 10A in FIG. 14A. However, the second, curved sidewall 16D in FIG. 14D forms a semi-circular shape.

Figure 14E:
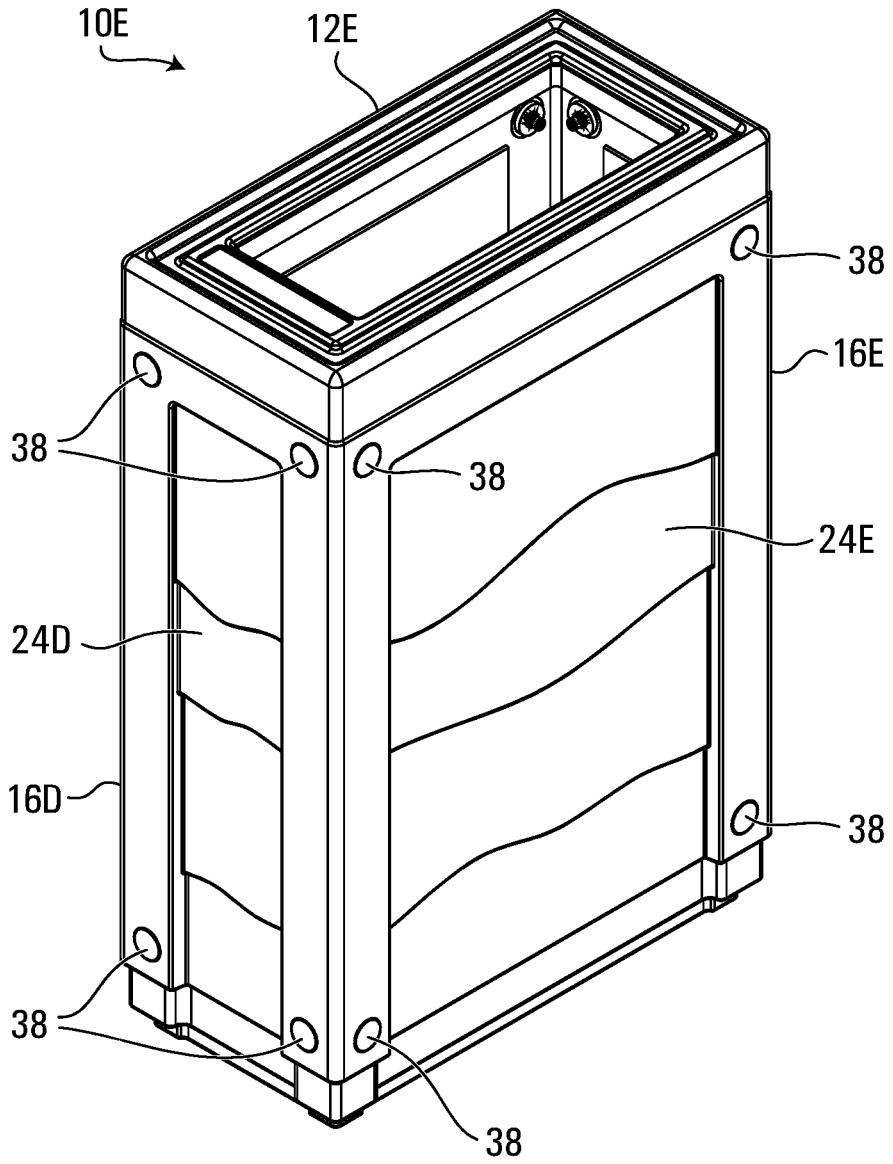

In FIG. 14E, the container 10E has four sidewalls 16E, as in FIGS. 1 to 13, but the base 14E forms a rectangular shape. Sockets 32, depicted with plugs 38 inserted, are found on all four sidewalls 16E.

The containers 10, 10A, 10B etc. may be produced and manufactured using a variety of methods known to a person skilled in the art. In one method, the containers 10, 10A, 10B, etc. are moulded, in particular rotation moulded. When the containers are rotation moulded, the tapering of the stepped surfaces 24, 24A, 24B, etc. on the sidewalls 16, 16A, 16B, etc. may aid the removal of the containers 10, 10A, 10B, etc. from the mould.

The containers 10, 10A, 10B, etc. may be produced from a variety of materials or combinations of materials, including, but not limited to, thermoplastics.

Figure 15:
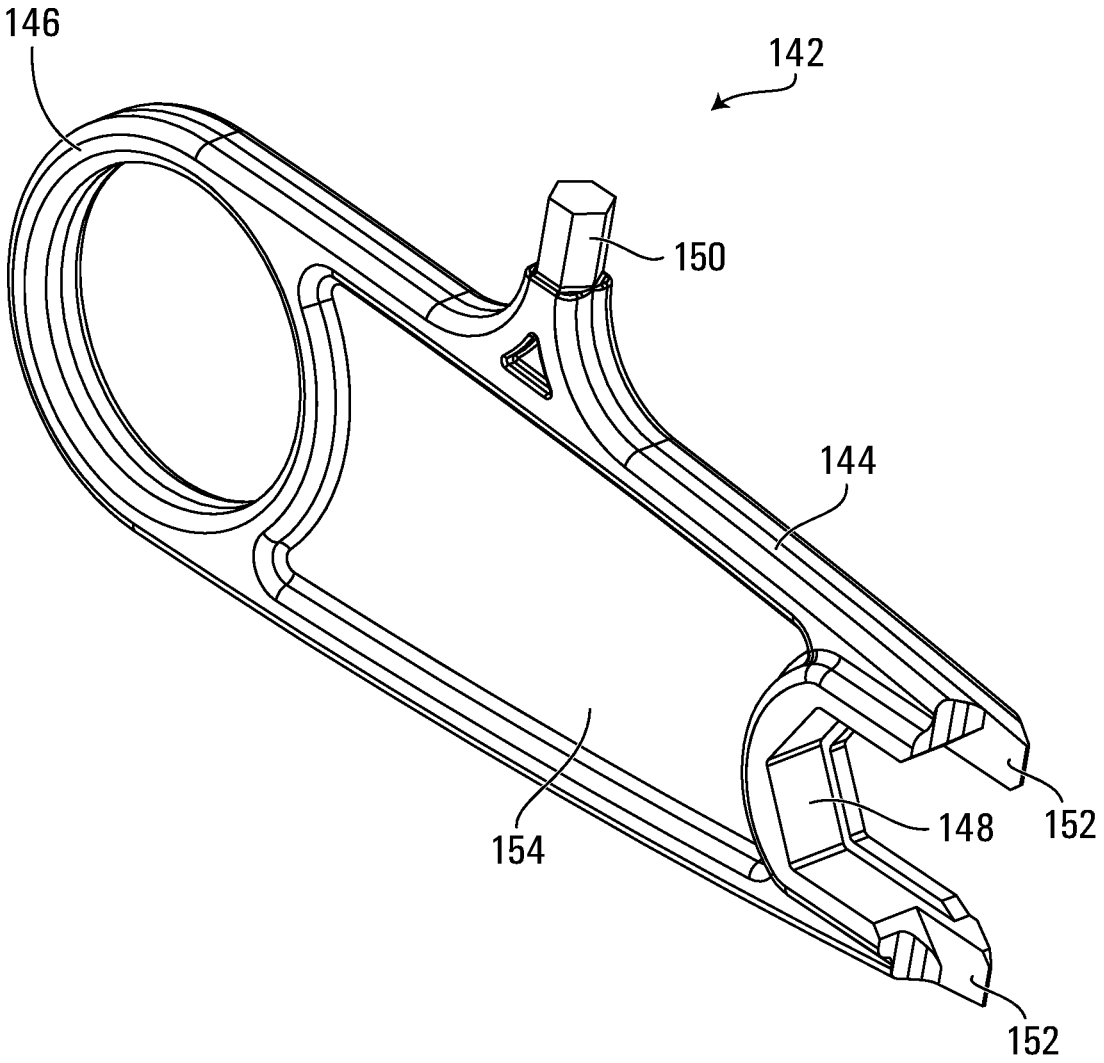
FIG. 15 is a perspective view of a tool according to an embodiment of the invention.
Figure 16:
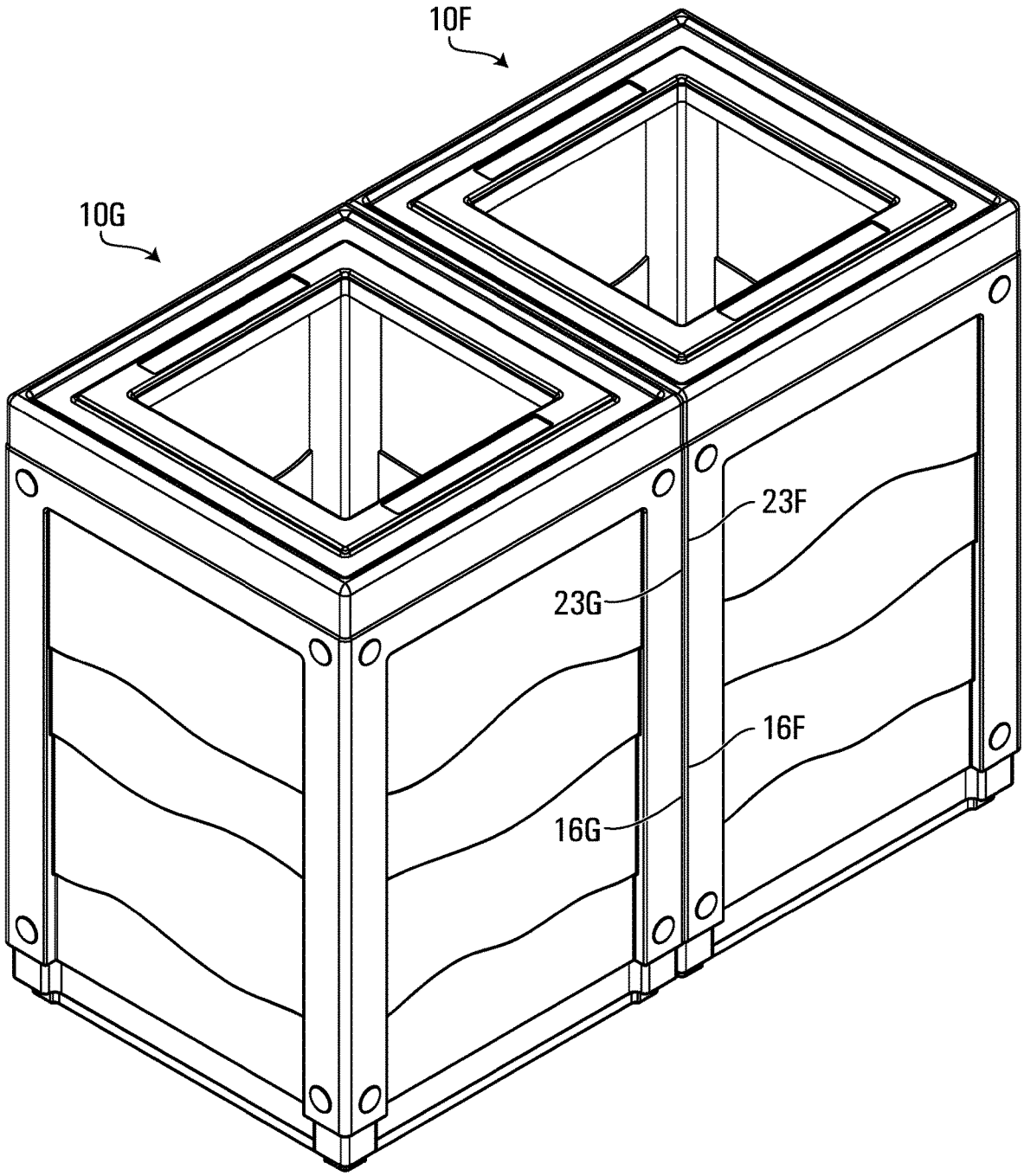
FIG. 16 is a perspective view of a modular container system according to an embodiment of the invention.
Figure 17:
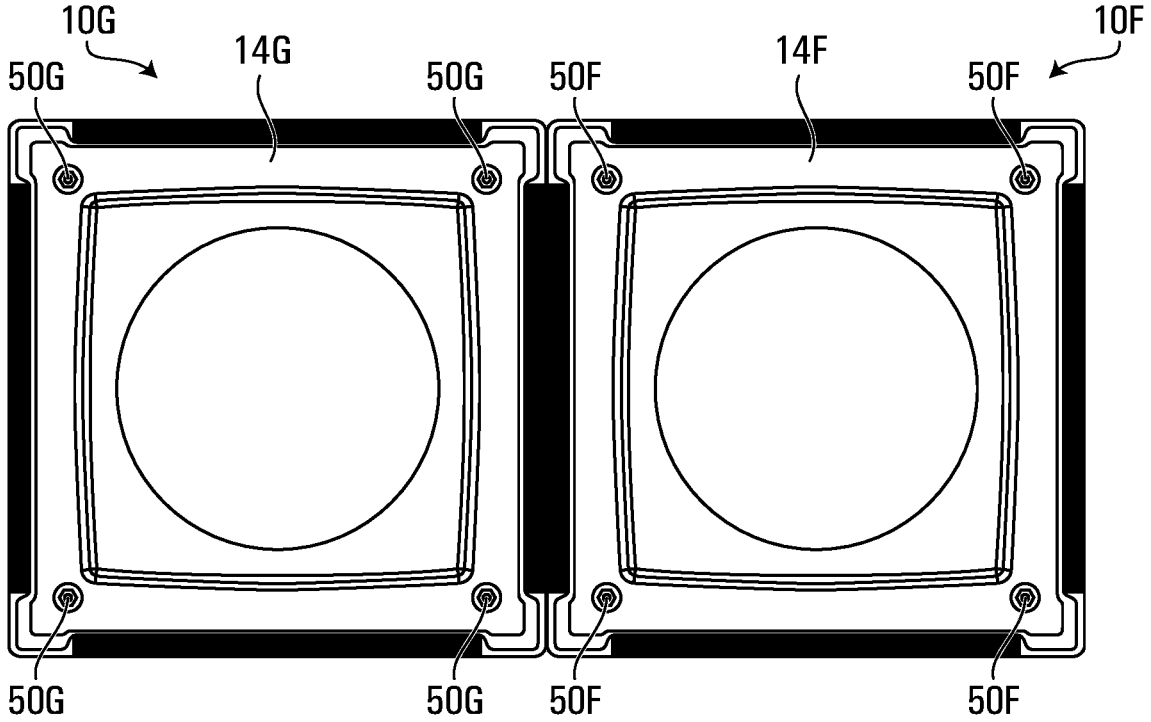
FIG. 17 is a bottom view of the modular container system of FIG. 16.

FIG. 15 depicts a tool 142 that may be used with the modular system according to embodiments of the invention. The tool 142 is used to install and uninstall or adjust various components of the modular system of containers, such as the magnets 34, the ferromagnetic inserts 36, the plugs 38, the feet 51 and the castors 52.

In the embodiment shown, the tool 142 comprises a flat, elongated tool body 144 that includes a ring 146 on one end and an open ended wrench portion 148 on another other end. In this embodiment, the tool body 144 includes a hex key portion 150 sized to be inserted in the hex sockets 114, 126 of the magnet 34 and ferromagnetic inserts 36. The hex key portion 150 protrudes from a side of the tool body 144 between the ring 146 and the open ended wrench portion 148.

The tool 142 also includes at least one wedge 152 for inserting between the cap 132 and the contact surface 92 to pry the cap 132, and thus the plug 38, away from and out of the socket 32. The embodiment shown includes two wedges 152 that are each integral with an end of the open ended wrench portion 148.

The flat tool body 144 may include an area 154 for writing or other descriptive matter.

The ring 146 may improve user handling by allowing a user to apply torque if the hex key portion 150 or open ended wrench portion 148 are used or to apply leverage when the wedge 152 is used to pry of the plug 38.

The open ended wrench portion 148 is provided to adjust the height of the feet 51 or the castors 52 if the user has chosen to use either of them. As such, the open ended wrench portion 148 is sized to fit a height adjusting nut (not shown) on the feet 51 or the castors 52.

The tool 142 may be provided as part of a kit, which also includes a modular waste disposal or recycling container 10, one or more magnets 34, one or more ferromagnetic inserts 36, and one or more plugs 38.

The kit, with or without instructions, may be provided to the user so that the user can switch out the magnets 34, ferromagnetic inserts 36, and plugs 38 on the container 10 to enable various arrangements with other containers as described below.

As the tool 142 is adapted to be used with the magnets 34, ferromagnetic inserts 36 and plugs 38, it is understood that if different embodiments of these elements are used, the tool will be adapted to be used with these different embodiments. For instance, instead of a hex key portion, the tool might have a slot screwdriver head to be used on a corresponding slot in the bolt heads 110, 122 of the magnet 34 and ferromagnetic inserts 36. It is also to be understood that portions of the tool may be omitted depending on the configuration of elements being used. For instance, the hex key portion 150 may be omitted if the magnets 34 and the ferromagnetic inserts 36 are not screwed into the second bore 106 and received in sockets 32 in a different manner as described above. In some embodiments, there may be no need for a tool 142 at all because all the elements may be installed or uninstalled without the help of a tool.

FIGS. 16 to 19 depict a modular system of waste disposal containers 10. In FIGS. 16 to 19, the same reference numbers are used as in FIGS. 1 to 13 but a "F" has been added to denote parts of the first container 10F on the right and a "G" has been added to denote parts of the second container 10G on the left to facilitate the following explanation.

In the embodiment shown, each of the containers 10F, 10G is substantially similar to the container 10 discussed above in respect of FIGS. 1 to 13. A first sidewall 16F of the first container 10F is placed adjacent to a second sidewall 16G of the second container 10G. The first sidewall 16F includes one or more first magnetic portions (not shown), such as the magnets 34, and the second sidewall 16G of the second container 10G includes one or more second ferromagnetic portions (not shown), such as the ferromagnetic inserts 36. The remainder of the sockets 32F, 32G have the plugs 38 inserted. The first and second sidewalls 16F, 16G magnetically and releasably adhere to one another when the one or more first magnetic portions are placed adjacent to the one or more second ferromagnetic portions.

In the embodiment shown, the magnetic and ferromagnetic portions are configured so that the containers 10F, 10G can be separated using human force.

It is important to note that each of the first and second sidewalls 16F, 16G may include both magnetic and ferromagnetic portions. As such, the first sidewall 16F may include one or more first ferromagnetic portions and the second sidewall 16G may include one or more second magnetic portions. For instance, the top two sockets 32F of the first sidewall 16F could have the magnets 34 inserted while the bottom two sockets 32F have the ferromagnetic inserts 36 inserted, a complementary arrangement being found on the second sidewall 16G.

Due to the configuration of the first magnetic portions and the second ferromagnetic portions, a first perimeter 23F of the first sidewall 16F contacts a second perimeter 23G of the second sidewall 16G when the first magnetic portions are placed adjacent to the second ferromagnetic portions. In some embodiments, substantially all of the perimeters 23F, 23G contact each other. This may provide an appearance that the two containers form a single unit.

It is to be understood that different embodiments of the containers may be employed in the modular system. The terms "magnetic portions" and "ferromagnetic portions" are being used to encompass a variety of possible embodiments, including the magnets 34 and ferromagnetic inserts 36 described herein and alternative embodiments thereof. For instance, in some embodiments, the magnetic and ferromagnetic portions could be configured as strips that are attached to the sidewalls without any sockets 32. These strips could be attached using adhesive or some other connection means, such as a hook and loop system. If adhesive is used, a solvent may be used to dissolve the adhesive.

In some embodiments, the magnetic and ferromagnetic strips could have complementary shapes. For instance, the magnetic strip might be raised, while the ferromagnetic strip might include a complementary channel to receive the raised magnetic strip, or vice versa.

In the embodiments where the magnet 34 protrudes or includes a protrusion and the ferromagnetic insert 36 is recessed or includes a complementary recess or aperture, or vice versa, the combination of the protrusion and recess or aperture may also provide an alignment function when the two containers 10F, 10G are placed adjacent to each other and connected. In such embodiments, depending on the shapes of the protrusions and the recesses or apertures, these features may also provide a guiding function to allow a user to connect the containers 10F, 10G. This may be helpful if, for instance, it is difficult to see whether the magnetic portions and the ferromagnetic portions are lined up.

If the containers 10F, 10G were merely placed adjacent to each other without connecting them, minor differences in the dimensions of the containers 10F, 10G due to their manufacturing, might result in an undesirable gap being formed between the first and second sidewalls 16F, 16G. In particular, the gap might be larger in some areas and smaller in others due to the minor variability introduced in, for instance, the moulding process used to mould the containers 10F, 10G. However, the use of magnetic and ferromagnetic portions might compensate for these variations in the production process.

Thus, in some embodiments, when the one or more first magnetic portions are placed adjacent to the one or more second ferromagnetic portions, the magnetic force causes a flexing of either or both of the first and second sidewalls 16F, 16G. This flexing may reduce the gap between the first and second sidewalls 16F, 16G and may aid in increasing contact between the first and second sidewalls 16F, 16G.

Similarly, in some embodiments, when the one or more first magnetic portions are placed adjacent to the one or more second ferromagnetic portions, the magnetic force is sufficient to compensate for planar irregularities in the first and second sidewalls in order to reduce a gap between the first and second sidewalls.

Additional containers 10 may be included in the modular system. A variety of arrangements with different numbers of the containers 10 are possible, depending on which of the sidewalls are provided with magnetic and ferromagnetic portions. For instance, using four square containers 10 as per the embodiment shown in FIG. 16, one could arrange the containers in a cross, in a row, in an "L" shape, in a "T" shape and so on.

A user may initially choose to arrange the containers in one way and then later decide to alter the arrangement. This can be done by separating the containers 10, moving the magnetic and ferromagnetic portions as desired and then re-adhering the containers in the desired arrangement.

Different embodiments of containers 10 can be arranged and connected. For instance, one or more of the containers 10 as per the embodiment shown in FIGS. 1 to 10 could be used in a modular system with one or more of the containers 10A, 10B, 10C, etc., as per the embodiments shown in FIGS. 14A to 14E. In the embodiments where the sidewalls 16 include shapes that are complementary to shapes on other sidewalls 16, a user may choose to arrange containers 10 such that the complementary shapes on the sidewalls 16 mate. For instance, a container 10 with multiple concave portions on the sidewalls 16 could be arranged in various arrangements with a container 10 having multiple convex portions on the sidewalls 16.

According to the embodiments depicted in the figures, if a user wishes to alter the arrangement of the modular system, he or she would use the tool 142 discussed above to switch out the necessary sockets 32 by either removing or installing the magnets 34, the ferromagnetic inserts 36 or the plugs 38, as required. A user would then physically re-arrange the containers 10 to form a new arrangement.

For instance, if a user wished to replace a plug 38 with a magnet 34, the user would insert the wedge 152 in the gap 139 in between the cap 132 and the contact surface 92 to pry the cap 132 and thus the plug 38 off and out of the socket 32. The user would then line up the bolt portion 108 of the magnet 34 with the second bore 106 and use the hex key portion 150 to screw the magnet 34 into the socket 32 until the interior surface 118 contacts the contact surface 101. Similar steps would be followed to install the ferromagnetic insert 36. If necessary, the user could then perform the same steps on other sockets 32 with plugs 38 to install the magnets 34 or the ferromagnetic inserts 36.

Conversely, to replace a magnet 34 with a plug 38, the user would unscrew the magnet 34. Once the magnet 34 was removed, the user would line up the shaft 134 with the second bore 106 and press the plug 38 into the socket 32 until the under surface 138 contacts the contact surface 92. Similar steps would be followed to replace a ferromagnetic insert 36 with the plug 38.

To install the feet 51 or the castors 52, a user would screw them into the bushings 50 in a known manner. Once installed, the height of the feet 51 or the castors 52 could be adjusted by using the open ended wrench portion 148 to turn a height adjustment nut (not shown) on the feet 51 or the castors 52. Conversely, to uninstall the feet 51 or the castors 52, a user would unscrew them from the bushings 50 in a known manner.

What has been described is merely illustrative of the application of principles of embodiments of the present disclosure. Other embodiments, arrangements and methods can be implemented by those skilled in the art without departing from the scope of the present invention.

The invention claimed is:

1. A modular waste disposal or recycling container comprising:

a base; and one or more sidewalls extending upwardly from the base, wherein the base and the one or more sidewalls together define an interior space for receiving waste or recyclables, wherein a sidewall of the one or more sidewalls comprises one or more sockets on an exterior of the sidewall, and wherein each of the one or more sockets comprises a recess formed by a recessed portion of the sidewall, wherein the recess defines an opening and is for receiving one of a magnetic or ferromagnetic insert to aid in adhering the container to another container, wherein each of the one or more sockets receives a respective removable plug, and wherein the plug comprises a cap sized larger than the opening to cover the opening.

2. The container of claim 1, wherein a bore in the recessed portion of the sidewall removably receives a shaft of the plug extending from the cap.

3. The container of claim 2, wherein the bore is threaded and wherein the shaft of the plug is press fit into the bore.

4. The container of claim 1, wherein wherein the plug is removably received in a bushing positioned in the recessed portion of the sidewall.

5. The container of claim 1, wherein the sidewall has a polygonal shape with a perimeter, wherein the one or more sockets are arranged along the perimeter.

6. The container of claim 1, wherein the sidewall has a rectangular shape, wherein the one or more sockets comprise four sockets, and wherein each of the four sockets is located in a corner of the sidewall.

7. The container of claim 1, wherein the one or more sockets comprise at least two sockets, and wherein the at least two sockets are arranged to lie in a common plane.

8. A modular system of waste disposal or recycling containers, the system comprising two containers, each container comprising:

a base and one or more sidewalls extending upwardly from the base that together define an interior space for receiving waste or recyclables, the one or more sidewalls comprising first and second sets of one or more sockets on an exterior of the container, wherein each socket of the first set of sockets of each container removably receives either a magnet or a ferromagnetic insert to magnetically adhere the containers to each other, and wherein each socket of the second set of sockets of each container removably receives a plug with a cap that covers the socket.

9. The system of claim 8, wherein perimeters of the sidewalls of adjacent containers contact each other when the adjacent containers adhere to one another.

10. The system of claim 9, wherein substantially all of the perimeters contact each other.

11. The system of claim 8, wherein, when adjacent containers are adhered to one another, the magnetic force causes a flexing of either or both of adjacent sidewalls of the adjacent containers.

12. A modular waste disposal or recycling container kit, comprising:

a modular waste disposal or recycling container socket according to claim 1;

one or more magnets configured for inserting into the one or more sockets;

one or more ferromagnetic inserts configured for inserting into the one or more sockets;

and a tool configured for removing a plug of the one or more plugs from a respective socket and for installing one of the one or more magnets or one of the one or more ferromagnetic inserts into the respective socket.

13. The kit of claim 12, wherein the tool includes at least one wedge for inserting between the cap of the plug and the sidewall to pry the cap away from the sidewall.

14. The kit of claim 12, wherein each of the one or more sockets has a threaded bore, wherein the one or more magnets and one or more ferromagnetic inserts are capable of being screwed into the one or more sockets via the bore, and wherein the tool includes a hex key portion for screwing in or unscrewing the one or more magnets and one or more ferromagnetic inserts.

15. The kit of claim 12, further comprising one or more castors, wherein the base is capable of receiving the one or more castors, and wherein the tool includes an open ended wrench portion for adjusting a height of the one or more castors.

16. The kit of claim 15, wherein the tool includes at least one wedge for inserting between the cap of the plug and the sidewall to pry the cap away from the sidewall and wherein the at least one wedge is formed by tapering portions at distal ends of the open ended wrench portion.

* * * * *